US007708617B2

(12) United States Patent
Fildan et al.

(10) Patent No.: US 7,708,617 B2
(45) Date of Patent: May 4, 2010

(54) BRASSIERE PATCH CLOSURE

(75) Inventors: Gerhard Fildan, Vienna (AT); Karl Wanzenböck, Leobersdorf (AT)

(73) Assignee: Fildan Accessories (HK) Ltd, Kwun Tong, Kowloon (HK)

( * ) Notice: Subject to any disclaimer, the term of this patent is extended or adjusted under 35 U.S.C. 154(b) by 169 days.

(21) Appl. No.: 11/901,300

(22) Filed: Sep. 17, 2007

(65) Prior Publication Data

US 2009/0070969 A1 Mar. 19, 2009

(51) Int. Cl.
*A41C 3/00* (2006.01)

(52) U.S. Cl. ..... 450/63; 450/82

(58) Field of Classification Search ..... 450/58, 450/63, 71, 77, 79, 80, 82; 24/618–625, 24/662, 681, 687–692, 108; 2/96
See application file for complete search history.

(56) References Cited

U.S. PATENT DOCUMENTS 6,837,771 B2 * 1/2005 Falla ..... 450/39
6,925,692 B2 * 8/2005 Yang ..... 24/681
7,128,635 B1 * 10/2006 Liu ..... 450/39
7,431,631 B2 * 10/2008 Fildan et al. ..... 450/71

* cited by examiner

*Primary Examiner*—Gloria Hale
(74) *Attorney, Agent, or Firm*—Andrew Wilford

(57) ABSTRACT

A pair of brassiere wings having ends meeting on a longitudinal centerline are interconnected by a closure having a flexible first patch fixed to on of the wing ends and provided with a plurality of fastener members and a flexible second patch fixed to the other of the wing ends and provided with a fastener member engageable with the members of the first patch. A stiff bar extending transversely of the centerline is fixed to the second patch and concave toward a wearer of a brassiere having the wings. One of the patches is of a shape that is longest parallel to the centerline than transversely offset therefrom so that it reduces longitudinal elastic deformation of the respective wing end at the centerline more than offset therefrom.

12 Claims, 3 Drawing Sheets

BRASSIERE PATCH CLOSURE

This application is related to copending application Ser. No. 11/296,581 filed 7 Dec. 2006 with reference back to then application Ser. Nos. 10/978,238 filed 29 Oct. 2004 (now U.S. Pat. No. 7,435,154) and 11/025,679 filed 28 Dec. 2004 (now U.S. Pat. No. 7,431,631).

FIELD OF THE INVENTION

The present invention relates to a brassiere. More particularly this invention concerns a patch closure for the back wings of a brassiere.

BACKGROUND OF THE INVENTION

In a typical brassiere a pair of brassiere wings are attached to a cup structure and can form the back of the brassiere. The wings are normally at least somewhat elastic and are provided with fastener elements which allow them to be detachably engaged with one another to form a closed back and to be opened to permit the garment to be put on or taken off.

In the above-mentioned applications, we have described the formation of brassiere wings with a closure that is attached as a premade units to a cup structure to form the back of a brassiere. The shoulder straps may be connected between that cup structure and these wings and the fastener elements on the wings are preferably combined press button and hook fasteners which can be engaged by the insertion of a head of the male member into the recess formed by a notch in the female member. The fasteners described as injection molded synthetic-resin snap-type hook and eye connectors and are of the type described in U.S. Pat. No. 6,557,232 were injection molded directly onto the laminated wings. The fasteners have the advantage that they can be engaged via an action similar to that used to engage standard hook and eye connectors, but can be separated by being pulled apart perpendicular to the wings like a snap fastener.

A problem with these closures is that they can open on their own. Furthermore the tension in the back wings can cause the closure to form an unattractive bump in the middle of the wearer's back.

OBJECTS OF THE INVENTION

It is therefore an object of the present invention to provide an improved brassier-wing closure.

Another object is the provision of such an improved brassier-wing closure that overcomes the above-given disadvantages, in particular that holds well and that lies flat when closed.

SUMMARY OF THE INVENTION

A pair of brassiere wings having ends meeting on a longitudinal centerline are interconnected by a closure having according to the invention a flexible but somewhat stiff and inelastic first patch fixed to on of the wing ends and provided with a plurality of fastener members and a flexible but also somewhat stiff and inelastic second patch fixed to the other of the wing ends and provided with a fastener member engageable with the members of the first patch. A stiff bar extending transversely of the centerline is fixed to the second patch and concave toward a wearer of a brassiere having the wings.

Thus this bar ensures that the wing ends will not curl outward at the fastener and that instead the wings of the brassiere will lie flatly against the user's back. This prevents the unattractive bump or outcurling that occurs here and that is frequently visible through the wearer's clothing.

Furthermore according to the invention the wing ends are elastic and the patches each include an inelastic backing sheet. The combination includes extending around perimeters of the backing sheets securing the sheets in a continuous line to the respective wing ends so that the sheets substantially eliminate the ability of the respective wing ends to stretch inward of the respective perimeters. Typically the patches are secured by perimeter welds.

The backing sheets in accordance with the invention are flexible and the bar is of a rigid synthetic resin bonded to the respective backing sheet. Furthermore bar is between the respective backing sheet and the respective wing end. Thus it is neither visible nor can it directly engage the wearer.

The fastener members according to the invention are arrayed in pairs with the fastener members of each pair transversely flanking the centerline. They therefore assist the wing ends to lie flat on the wearer.

According to another feature of the invention one or both of the patches is of a shape that is longest parallel to the centerline than transversely offset therefrom so that the second patch reduces longitudinal elastic deformation of the respective wing end at the centerline more than offset therefrom. This further enhances the tendency of the wing ends to flatten themselves against the user since, when tensioned longitudinally, the tension will be greater in the less stretchable center of the wing ends and they will be pulled flat against the wearer.

More particularly, the second patch has a triangular portion with a corner generally on the centerline. More particularly the second patch can have a rectangular portion carrying the respective fastener members and a triangular end with a corner that points away from an outer end of the respective wing end. Such a patch is extremely easy to manufacture and install, and gives substantially better results than the prior-art rectangular patches.

This structure with the longer central dimension is further enhanced by use of the above-described stiffener bar.

Furthermore according to the invention the fastener members of one of the patches are formed with stiff but elastically deformable heads fittable with the fastener members of the other of the patches and formed with notches open parallel to the centerline. This makes it possible to unite the fastener members by sliding the two wing members apart as in a standard hook/eye fastener, but allows them to be separated by simply pulling back the rear wing end to pop the fastener open.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
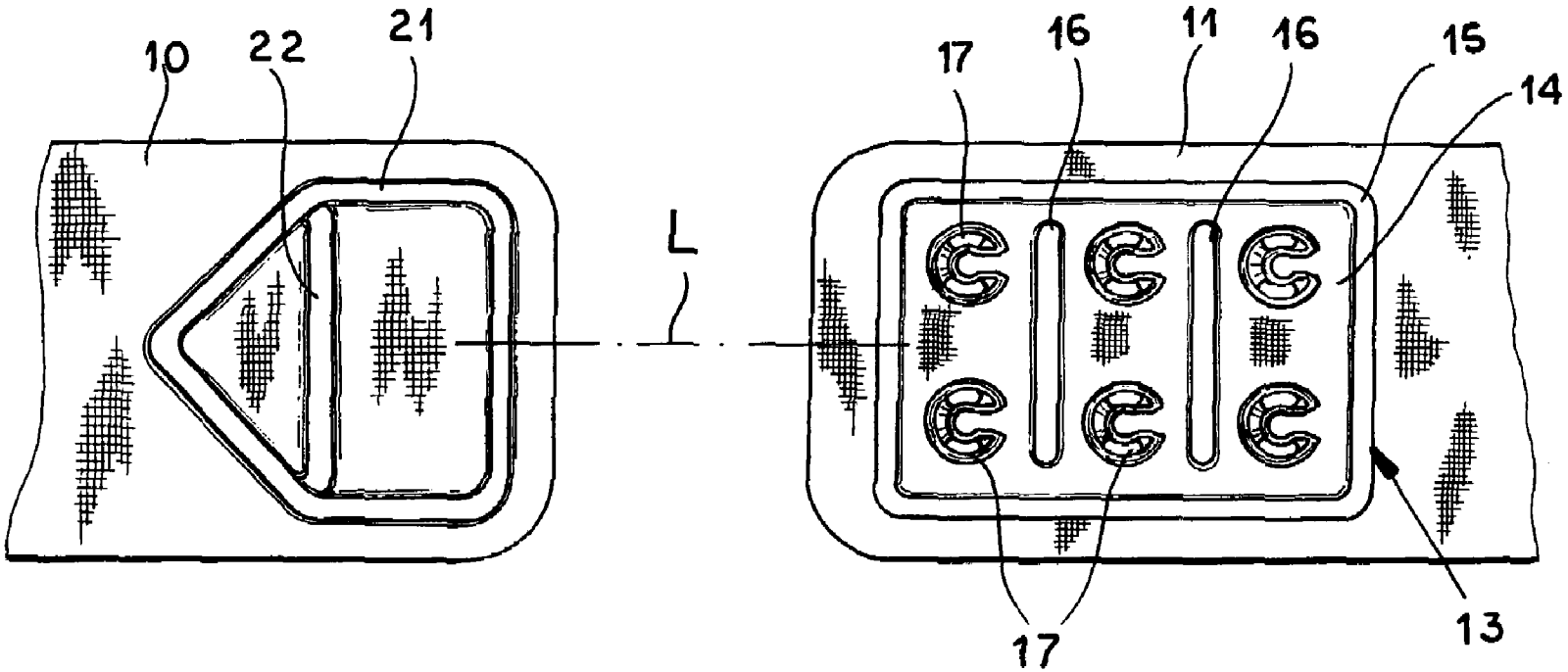
FIG. 1 is a rear view of two unjoined wing ends with the closure according to the invention.
Figure 2:
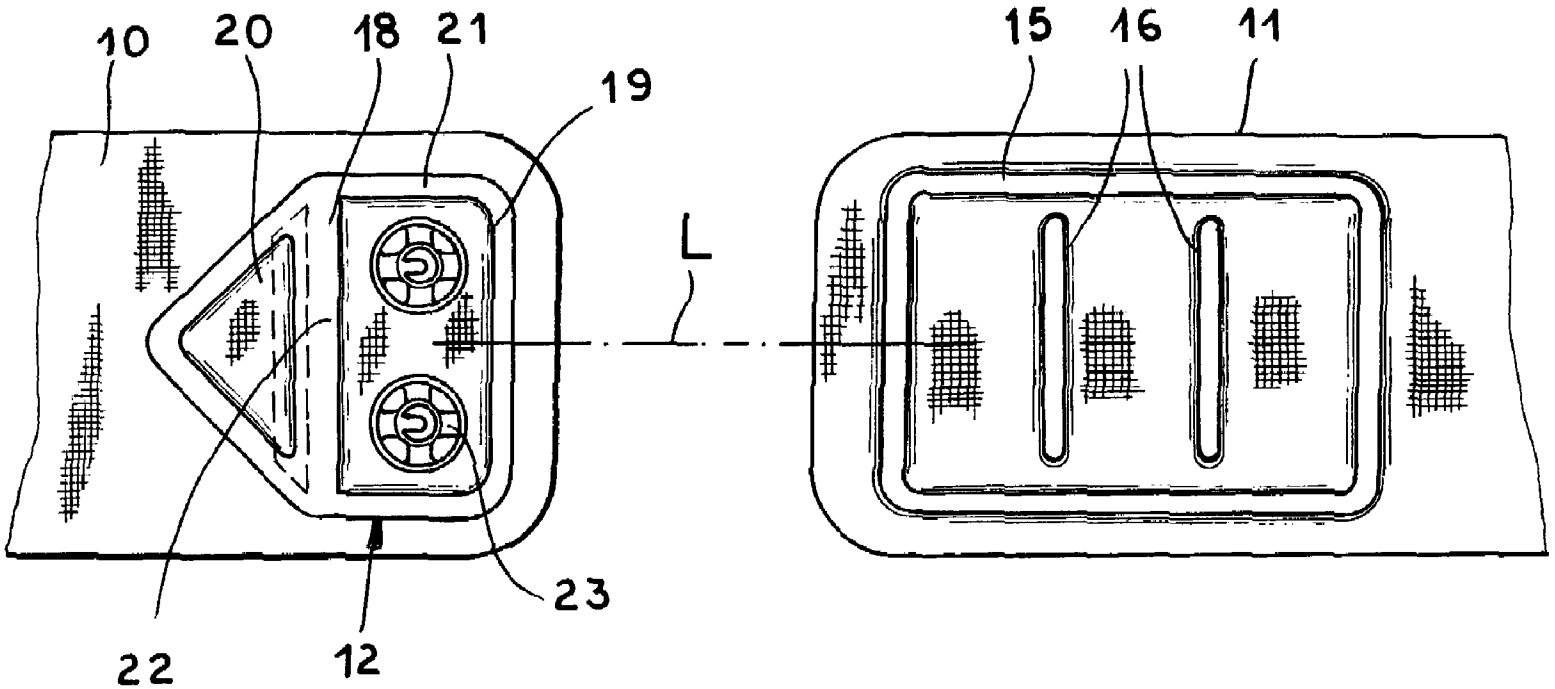
FIG. 2 is a front view of the two unjoined wing ends as in FIG. 1.

As seen in FIGS. 1 and 2 the ends of a pair of standard wings 10 and 11 made of elastic stretch fabric are provided with respective closure patches 12 and 13 and both extend along and are centered on a longitudinal centerline L. An unillustrated strap and cup structure as shown in FIG. 11 of above-cited application '581, which is wholly incorporated herewith by reference, is attached to the two stretch wings 10 and 11.

The patch 13 is generally identical to that in above-cited application '581. It has a rounded-corner rectangular backing sheet 14 of inelastic material secured by an annular perimeter weld 15 (or stitching) to the respective wing end 11 at a spacing from its edges and at two transverse intermediate line welds 16 (or stitch rows) subdividing it into three longitudinally spaced zones each carrying two female fastener members 17 of U-shape open away from the end of the wing 11.

The patch 12 according to the invention comprises a backing sheet 18 with a main rectangular region 19 spaced slightly inward of the edges of the end 10 and a region 20 of isosceles-triangular shape centered on the line L and pointed away from the free end of the wing end 10. This sheet 18 is also made of flexible and inelastic material, like the sheet 14, and is bonded to the wing end 10 by a perimeter weld 21 (or stitching) and a crosswise strip weld 22 between the regions 19 and 20. A pair of male fastener members or posts 23 are fixed to the region 19 and transversely spaced identically to the pairs of female members 17 of the patch 13 so that they can be joined therewith in the manner known in the art.

Figure 4:
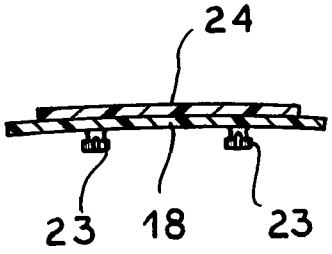
FIGS. 4 and 5 are sections taken along respective lines IV-IV and V-V of FIG. 3.
Figure 3:
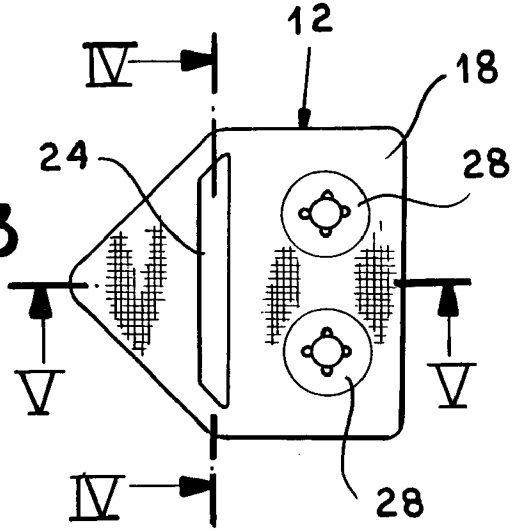
FIG. 3 is a detail front view of the stiffened closure patch according to the invention.
Figure 5:
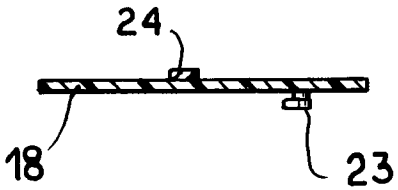

As further shown in FIGS. 3, 4, and 5, the patch 12 is provided generally at the edge of the region 20 closest to the region 19 with a crosswise stiffening bar 24. This bar 24 is formed of a stiff but moderately flexible plastic and is not of planar shape, but instead is slightly arcuate and concave forward, that is toward the wearer of the brassiere incorporating the wings 10 and 11. The bar 24 is bonded to the back face of the sheet 18 so that, when the sheet 18 is in turn secured to the front face of the wing 10, it is wholly contained between the sheet 18 and wing 10. The bar 24 is of right-trapezoidal shape and extends perpendicular to the line L, with its angled sides parallel to but set in from the adjacent edges of the triangular region 20.

Figure 6:
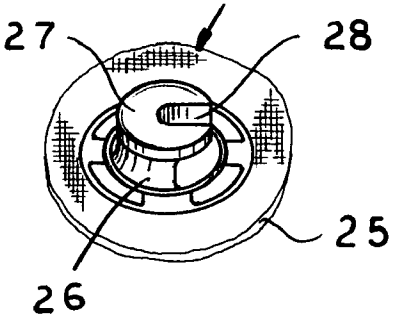
FIG. 6 is a large-scale perspective view of the male part or post of the closure in accordance with the invention.

The fastener members 26 as shown also in FIG. 6 each are made unitarily of stiff but elastically deformable plastic with a circular base disk 25 from the center of which extends a short cylindrical post 26 having a horseshoe-shaped head 27 with a notch 28 open outward parallel to the line L. The notch 28 opens inward, away from the free end of the respective wing 10, and allows the head 26 to compress somewhat in its plane transversely of the line L so that it can be snapped out of the fastener member 17 it is fitted to. The bottom of the post 26 projects through the sheet 18 and has four small tabs 29 (FIG. 3) that allow it to be welded solidly to this sheet 18.

With this system the heads 27 of the fastener members 23 can be pulled in the plane of the two wings 10, that is parallel to the line L, to fit in the members 17 and lock the two wings 10 together just like a standard hook/eye connection. On the other hand, if the two wings 10 and 11 are pulled apart perpendicular to their plane, that is perpendicular to the line L and the plane of the view in FIGS. 1 and 2, the heads 27 will compress and snap out of the members 17. The wearer therefore dons the brassiere like a standard brassiere, and it will stay secured as solidly as a standard brassiere because tension pulling the two wings 10 apart in their plane is as solidly resisted as by a standard hook/eye fastener, but the wings 10 and 11 can be simply separated by peeling the rear wing end 10 back away from the front wing end 11. Since this type of separation is never likely to happen accidentally, it means that the brassier stays fastened like a standard brassiere, but is easier to remove.

Furthermore the combination of the arcuate stiffener 24 and the shape of the backing sheet 18 ensures that longitudinal tension applied to the two wings 10 and 11 when they are secured together by the fastener members 17 and 23 will cause the wings to lie flatly on the wearer's back. This is in part caused by the shape imparted to the structure by the stiffener 24. It is also created by the differential stretching of the wing 10 caused by the fact that the nonstretchable backing sheet 18 is longer in its central region on the line L than outward therefrom. This will cause tension to be somewhat greater in the center of the wing 10 because its stretchability is centrally reduced by the backing sheet 18, and will cause it to pull tight and press the edge regions against the user. The rear wings will therefore lie comfortably flatly against the wearer's back.

We claim:

1. In combination with a pair of brassiere wings having ends meeting on a longitudinal centerline, a closure for interconnecting the ends, the closure comprising:

a flexible and generally inelastic first patch fixed to one of the wing ends and provided with a plurality of fastener members;

a flexible and generally inelastic second patch fixed to the other of the wing ends and provided with respective fastener members engageable with the members of the first patch; and a stiff bar extending transversely of the centerline, fixed to the second patch and concave toward a wearer of a brassiere having the wings.

2. The brassiere closure defined in claim 1 wherein the wing ends are elastic and the patches each include an inelastic backing sheet, the combination including means extending around perimeters of the backing sheets securing the sheets in a continuous line to the respective wing ends, whereby the sheets substantially eliminate the ability of the respective wing ends to stretch inward of the respective perimeters.

3. The brassiere closure defined in claim 2 wherein the securing means are perimeter welds.

4. The brassiere closure defined in claim 2 wherein the backing sheets are flexible and the bar is of a rigid synthetic resin bonded to the respective backing sheet.

5. The brassiere closure defined in claim 4 wherein the bar is between the respective backing sheet and the respective wing end.

6. The brassiere closure defined in claim 1 wherein the fastener members are arrayed in pairs with the fastener members of each pair transversely flanking the centerline.

7. In combination with a pair of brassiere wings having elastic ends meeting on a longitudinal centerline, a closure for interconnecting the ends, the closure comprising:

a flexible first patch fixed to one of the wing ends and provided with a plurality of fastener members; and a substantially inelastic but flexible second patch fixed to the other of the wing ends, provided with respective fastener members engageable with the members of the first patch, and secured solidly at its perimeter to the respective wing end, the second patch member further being of a shape that is longer parallel to the centerline than transversely offset therefrom.

8. The brassiere closure defined in claim 7 wherein the second patch has a triangular portion with a corner generally on the centerline.

9. The brassiere closure defined in claim 7 wherein the corner points away from an outer end of the respective wing end.

10. The brassiere closure defined in claim 7, further comprising:

a stiff bar extending transversely of the centerline, fixed to one of the patches and concave toward a wearer of a brassiere having the wings.

11. The brassiere closure defined in claim 10 wherein the stiff bar is fixed to the second patch.

12. The brassiere closure defined in claim 11 wherein the fastener members of one of the patches are formed with heads fittable with the fastener members of the other of the patches and formed with notches open parallel to the centerline.

* * * * *